US005899632A

United States Patent [19]

Martin

[11] Patent Number: 5,899,632

[45] Date of Patent: May 4, 1999

[54] BEACH RESTORATION STRUCTURE AND METHOD

[75] Inventor: Byron N. Martin, 10379 Thwing Rd., Chardon, Ohio 44024

[73] Assignees: David J. Eardley; Byron N. Martin, both of Chardon, Ohio

[21] Appl. No.: 08/804,278

[22] Filed: Mar. 3, 1997

[51] Int. Cl.[6] ..... E02B 3/04

[52] U.S. Cl. ..... 405/25; 405/21

[58] Field of Search ..... 405/19, 20, 21, 405/22, 24, 25, 27, 29, 30, 31

[56] References Cited

U.S. PATENT DOCUMENTS

| | | | |
|---|---|---|---|
| 421,631 | 2/1890 | Sutherland . | |
| 618,319 | 1/1899 | Averill . | |
| 810,630 | 1/1906 | Dwight | 405/31 |
| 1,010,189 | 11/1911 | Haupt . | |
| 1,880,838 | 10/1932 | Curney | 405/32 |
| 3,214,916 | 11/1965 | Martin . | |
| 3,851,476 | 12/1974 | Edwards | 405/25 |
| 3,892,075 | 7/1975 | Tibbett | 405/28 |
| 4,669,913 | 6/1987 | Temple | 405/15 |
| 4,784,520 | 11/1988 | Stevens | 405/21 |
| 4,790,685 | 12/1988 | Scott et al. | 405/30 |
| 4,818,141 | 4/1989 | Rauch | 405/31 |
| 5,011,328 | 4/1991 | Atkinson et al. | 405/32 |
| 5,102,257 | 4/1992 | Creter | 405/25 |
| 5,108,223 | 4/1992 | Folgado | 405/21 |
| 5,176,468 | 1/1993 | Poole | 405/23 |
| 5,238,326 | 8/1993 | Creter | 405/25 |

*Primary Examiner*—Tamara Graysay
*Assistant Examiner*—Frederick L. Lagman
*Attorney, Agent, or Firm*—Rankin, Hill, Porter & Clark LLP

[57] ABSTRACT

A beach building structure for underwater installation along the shoreline of a body of water having periodic onshore wave action. The structure includes a base frame adapted to rest on the bottom of the body of water, a ballast supporting member secured to the base frame in order to receive ballast such as rocks to help anchor the structure in position. A barrier plate is secured to the seaward portion of the base frame and is angularly disposed to slope upwardly and toward the shoreline and to extend above the mean water level to present a sloping surface to onshore waves.

9 Claims, 5 Drawing Sheets

BEACH RESTORATION STRUCTURE AND METHOD

BACKGROUND OF THE INVENTION

This invention relates to beach building and the related function of preventing shoreline erosion due to wave action. More particularly, the invention relates to a beach restoration structure which is placed in relatively shallow water a small distance from the shoreline, the structure being readily transportable to the shore site and adapted to be assembled in side-by-side relation with other units, in a partly submerged condition to define an off shore barrier.

Shorelines and beaches are subject to erosion from the action of waves impinging thereon. Wave action erodes beaches by several different mechanisms. Waves mobilize shoreline materials and then redistribute them. Shoreline structures including sea walls, pilings, etc. often increase beach erosion by causing wave reflection, turbulence, eddies and currents. These conditions mobilize the beach material which may be transported offshore, thus destroying the existing beach. Further, heavy storms can impinge high waves on beaches and shorelines imparting heavy forces which carry away the beach material and crumble the shoreline leading to catastrophic erosion.

In a natural beach/water ecosystem, the shallow water extending up to the beach and the beach face itself act to dissipate the energy of the waves, thereby preventing erosion of the land behind the beach. Typical waterfront profiles include (1) a surf zone of relatively shallow water where the waves break into surf, (2) a beach zone where a wave expends its last landward energy, and (3) the land behind the beach. During severe storm conditions when the waves are commonly two to three times their normal height or more, the typical result is the loss of material from the beach zone.

Many methods have been employed in an attempt to reduce shoreline erosion. These attempts have included both protruding and submerged breakwaters located offshore. The protruding breakwater reflects and/or dissipates the waves. A submerged breakwater either reflects and/or dissipates waves, or causes the waves to break further offshore. These breakwaters are typically constructed of concrete or stone and are solid structures, commonly rubble or rocks are piled in a line offshore to form a breakwater.

Breakwaters have several deficiencies. First of all, they are expensive to build and maintain. Rubble breakwaters erode by losing rock to the action of waves and unstable subsoils commonly cause the rocks or concrete segments to sink into the sea or lake bed. Wave action scours and undercuts the base of the breakwater and eventually causes portions to topple outward, thus rendering the structure useless.

Typically, these breakwater structures are built close enough to the shore for waves to come crashing in and hit with full force. The wall stops the forward movement of the wave and the wave ruptures transforming the forward energy of the wave into an equivalent level of vertical energy. The fraction of the wave deflected downward drives into the bottom material and the result is similar to directing a fire hose at the base of a wall causing scour and undercutting.

Revetments and sea walls are also used to reduce shoreline erosion. However, these structures actually inhibit beach formation. Although they may protect the shore behind the beach, they tend to erode the beach by creating intensified water currents which may permanently transport beach material away from the shore.

The unique beach building structure of the present invention resolves the difficulties described above and affords other features and advantages heretofore not obtainable.

SUMMARY OF THE INVENTION

In accordance with the present invention, a beach building structure is provided for partly submerged installation along the shoreline of a body of water having periodic on shore wave action. The unit is adapted to be positioned side-by-side with other units to form a relatively long barrier wall extending parallel to the shoreline. The structure has a generally horizontal base frame adapted to lie on the bottom of the body of water fairly close to shore. The base frame is formed by a pair of parallel frame members extending perpendicular to the shore line and connected together by cross bracing. The central portions of the parallel frame members and the cross bracing define a central zone which is adapted to form a bed or ballast support. The bed or ballast support may be a metal mesh welded to the frame members and is adapted to have natural material such as rocks placed thereon to anchor the structure in position on the bottom.

A sloping barrier plate is secured to a seaward portion of the base frame and extends upwardly and inwardly toward the shore. When installed, the top of the plate extends approximately 25% of its height (or 10" to 20") above the mean water level.

Bracing is provided and is disposed between the shoreward portion of the base frame and a location near the top of the barrier plate to firmly support the plate at the desired angular position presenting a sloping surface to offshore wave action.

Means are provided along the sides of each barrier plate to permit barrier plates of adjacent units to be secured together to form a composite barrier wall extending a substantial distance parallel to the shoreline.

DESCRIPTION OF THE PREFERRED EMBODIMENT

Figure 1:
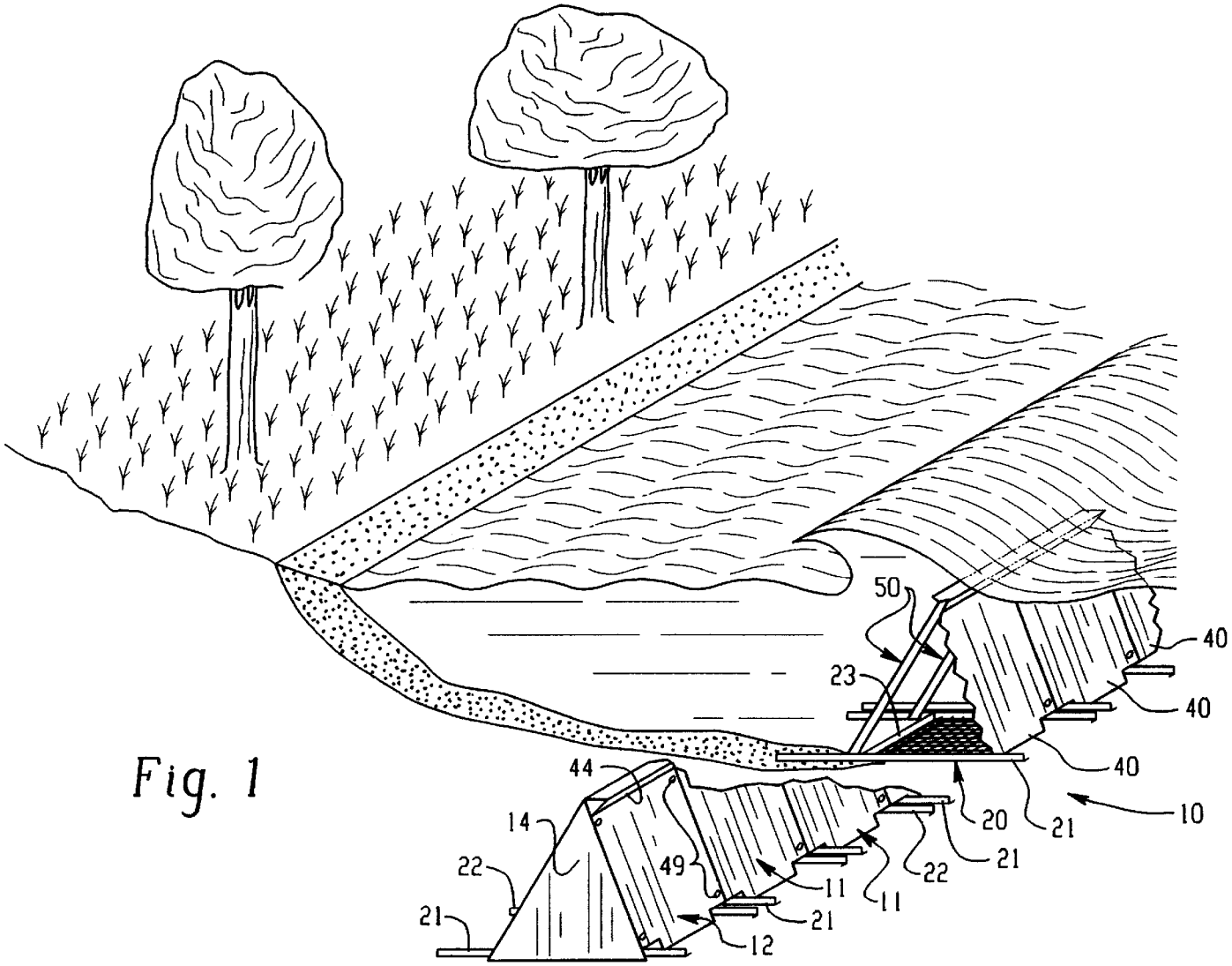
FIG. 1 shows a perspective view partially sectioned in a direction perpendicular to a beach to illustrate an assembly of beach building structures embodying the present invention, with parts broken away for the purpose of illustration.

Referring more particularly to the drawings and initially to FIG. 1, there is shown a beach restoration structure 10 formed of a number of interconnected primary units 11 and a left end unit 12. A right end unit is not shown but is essentially a mirror image of the left end unit 12. The basic components of each unit include a base frame assembly 20, a barrier plate assembly 40 and a pair of strut assemblies 50. The end units differ from the primary units only in that the unit 12 at the left hand end of the assembly as viewed from a position looking toward the shore, has a return plate or side plate 14 secured to its left hand side and the right end unit (not shown) located at the opposite end of the beach restoration structure assembly, has a similar side plate located on its right hand side. The side plates are supported by the respective barrier plates 40 and base frame assemblies 20. These side plates interrupt lateral movement of particle laden water away from the beach area being restored by the assembly 10.

Units 11 and 12 are bolted together along the sides of the respective barrier plates 40 so as to form a continuous sloping surface angularly disposed at approximately 60° so as to present a sloping barrier surface to off shore waves. The tops of the barrier plates should extend about 10" to 20" above the mean water level. An extension of about 18" has been found to be particularly suitable.

The description will be limited to the beach builder primary units 11 which differ from the end units only as to the side plates. The base frame assembly 20, which is identical for all units, includes a pair of parallel runners 21 and 22 extending generally perpendicular to the shoreline and connected to one another by cross members 23 and 24.

The runners and cross members are formed of steel angle with legs about 3" wide. They are assembled so that the vertical legs of the runners 21 and 22 are located outboard as are the vertical legs of the cross members 23 and 24. In other words, the vertical leg of the member 24 is located toward the shoreline and the vertical leg of the member 23 is located on the side away from the shoreline. The runners 21 and 22 have a pair of anchor holes 26 and 28 at the end toward the shoreline and another pair of anchor holes 25 and 27 at the end away from the shoreline. Steel spikes 29 (FIG. 2) are used to anchor the base frame assembly to the bottom of the respective body of water. These may be 3' spikes approximately 1" thick.

In order to provide a means for attaching the bottom of the barrier plate 40 to the base frame assembly 20, each of the runners 21, 22 has its vertical leg provided with a circular opening. The openings are in axial alignment and are adapted to receive a hinge rod 35 that extends therethrough from one side to the other. The rod has a head 36 at one end and is adapted to receive a cotter pin 37 at the opposite end.

A rectangular layer of steel mesh 38 is sized to fit the area defined by the central portions of the runners 21 and 22 on the one hand, and the cross members 23 and 24 on the other hand. The steel mesh layer is welded to the horizontal legs of the runners and cross members to provide a means to support stone ballast that may be used to anchor the unit in place on the bottom of the body of water.

The barrier plate 40 is essentially a steel plate having a thickness of about 3/16" in a typical construction. In the embodiment shown, the dimensions of the plate include a 4' width and a 7' length. The plate has a pair of parallel reinforcing ribs 41 and 42 welded to the surface facing toward the shoreline to provide additional rigidity. The bottom portion of the barrier plate 40 is attached to the base frame assembly 20 by means of a length of square tubing 43 welded to the very bottom edge of the plate. The square tubing 43 may be cut, for example, from 1" square steel tube and it is welded to the face of the plate 40 that faces the shoreline. The rod 35 extends through the hinge tube 43.

Figure 2:
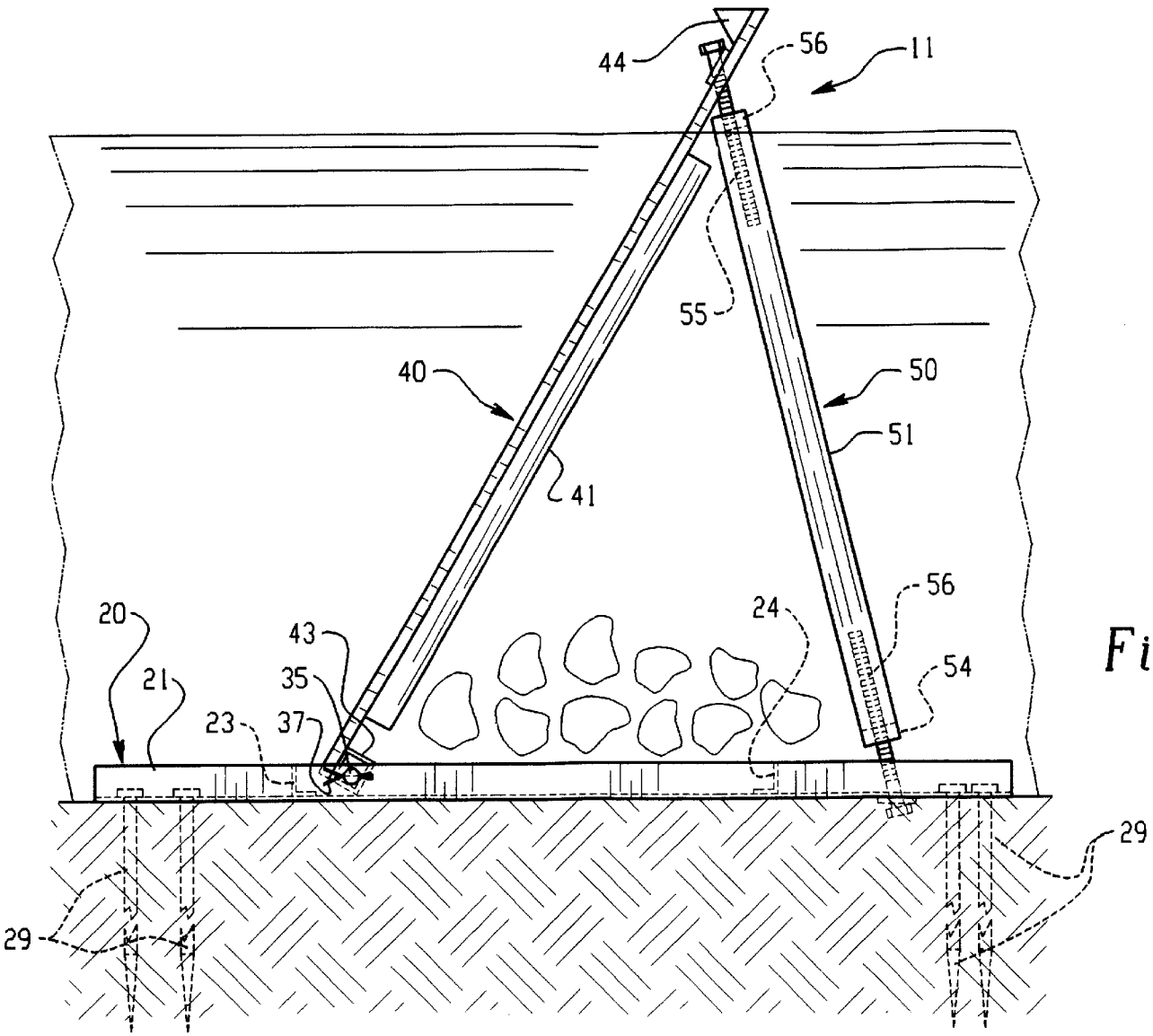
FIG. 2 is a side elevation of a beach building structure embodying the invention mounted in operative position at a offshore location and with the beach environment being shown in fragmentary form.
Figure 3:
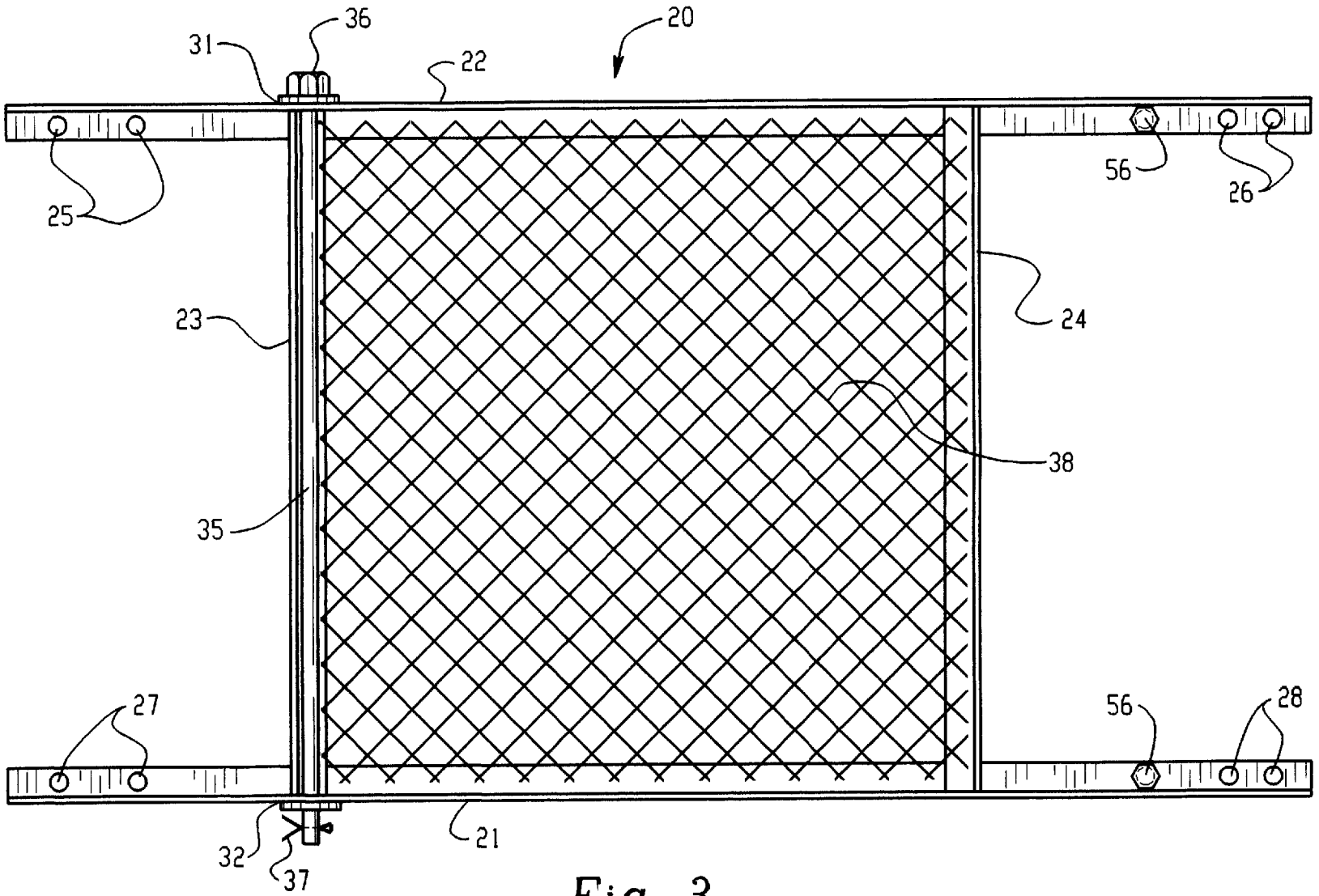
FIG. 3 is a plan view showing the base frame of the beach building structure of the invention with portions of the structure removed.
Figure 4:
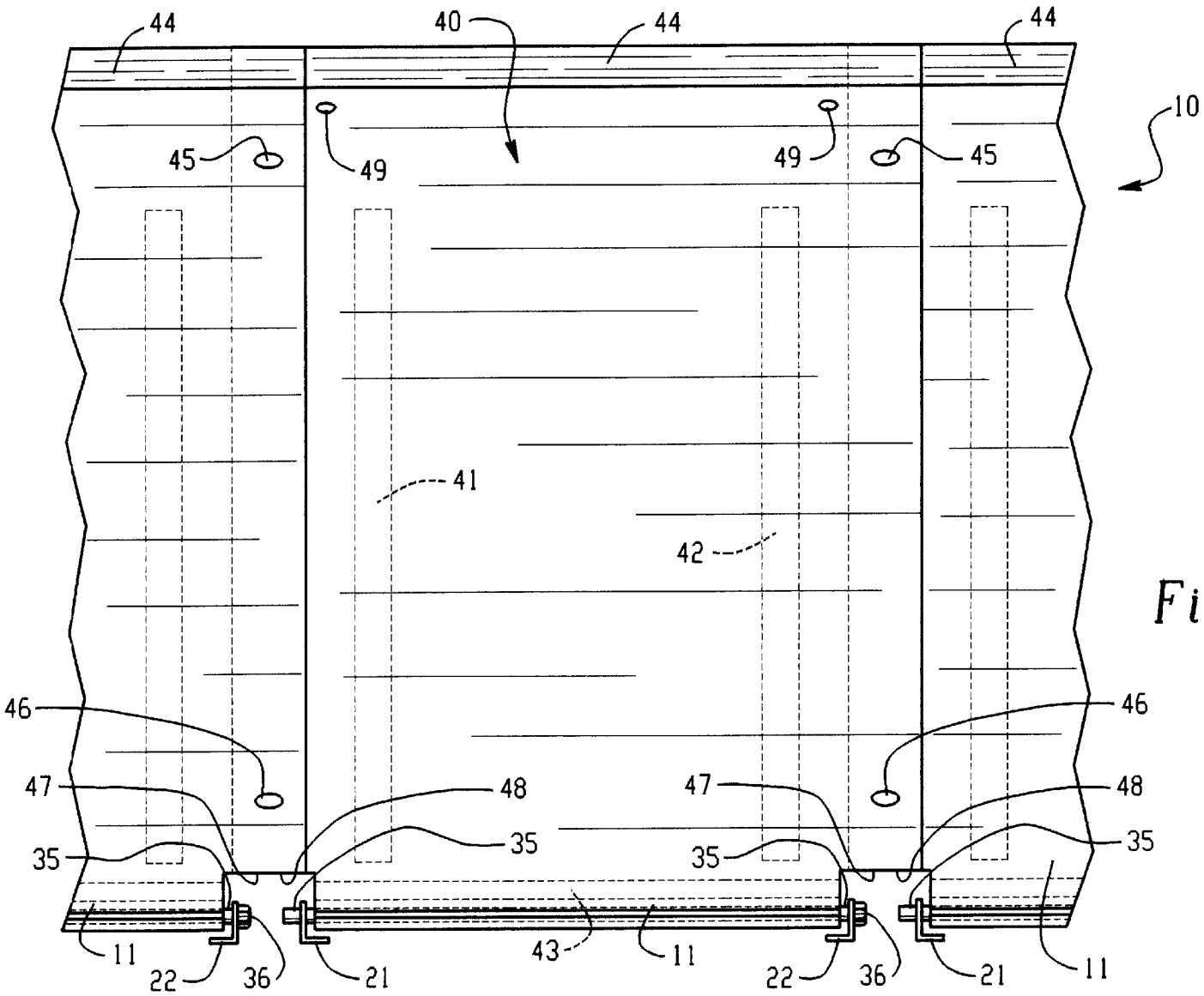
FIG. 4 is a front elevation illustrating one beach building structure of an assembly of said structures installed in a typical situation.

In order to keep waves from slipping up and over the top of the barrier plate too easily, a baffle 44 is welded to the top edge of the plate as shown in FIGS. 2 and 4. The baffle is merely steel angle which is welded to the top of the plate with the edges of its legs in contact with the plate so as to provide a sturdy baffle to deflect portions of waves.

Located on each side of the plate 40 near the side edges are a pair of holes or slots 45 and 46 which are used to secure adjacent barrier plates to one another. The barrier plates are located in an overlapping relation to align the respective holes or slots and permit the sides to be bolted to one another. It will be noted that the bottom ends of the plate have rectangular cutouts 47 and 48 formed therein as shown in FIG. 4 so that when the units are assembled to one another, the respective runners 21 and 22 will not interfere with the overlapping relationship.

Finally, each barrier plate 40 is provided with a pair of holes or slots 49 near the top, one of which is located along each side. The holes or slots 49 are for use in attaching the strut assemblies 50 to support the barrier plate in its desired angular position.

As indicated above, a suitable angle for the sloping surface of the plate is about 60°, although the advantages of the invention may be realized over a wide range of slope angles. It will be noted that due to the means thus described for connecting the barrier plate 40 to the base frame assembly 20, the two components 20 and 40 may be shipped flat to the assembly site, after which the barrier plate 40 may be swung upwardly to the desired position and braced with the strut assemblies 50.

Figure 5:
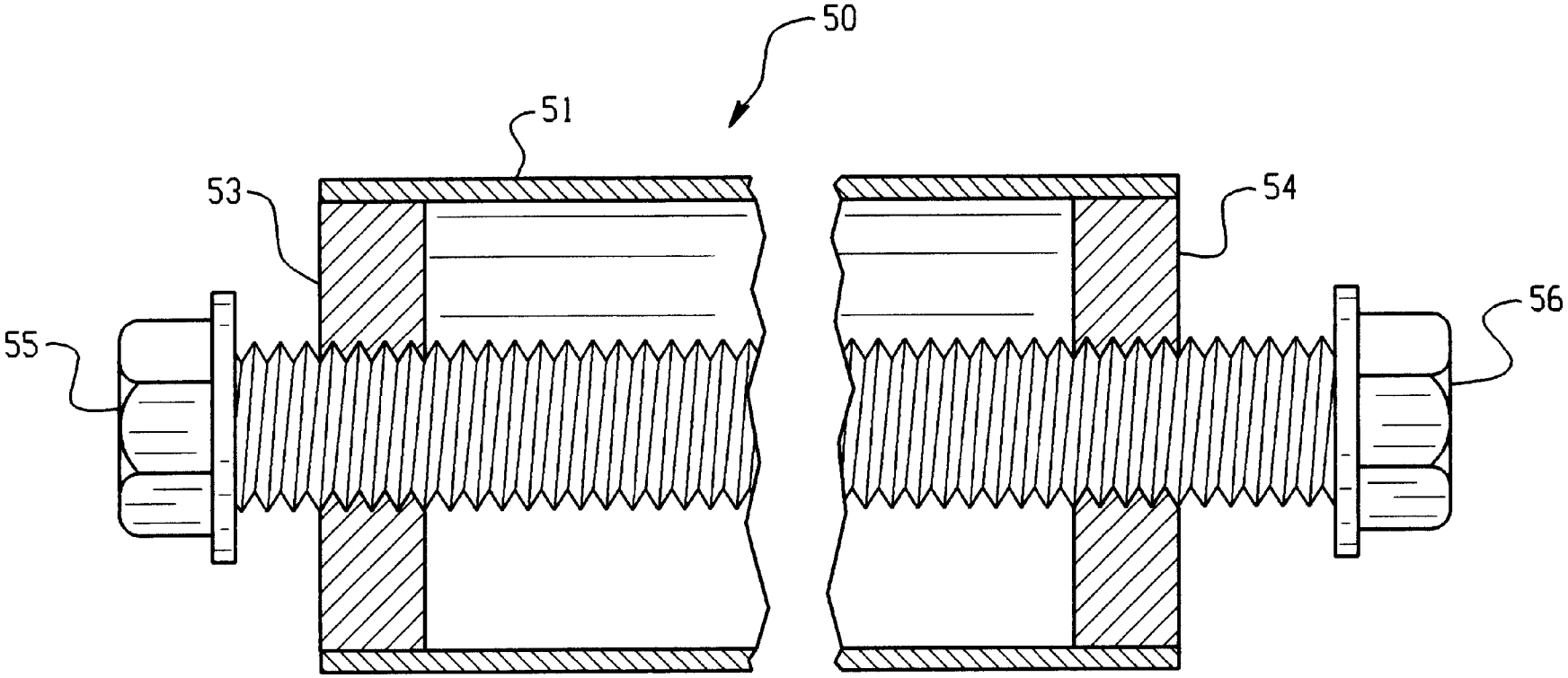
FIG. 5 is a broken elevational view illustrating one of the braces used in the beach building structure of the invention.

The strut assemblies 50 are best shown in FIGS. 2 and 5. Since they are identical and interchangeable, the construction of only one strut assembly 50 will be described herein.

Each assembly comprises a cylindrical steel tube 50 having a typical diameter of about 2" and a typical length of about 5'. The length is determined by the desired slope angle of the barrier plate.

Each of the strut assemblies 50 is provided with upper and lower nuts 53 and 54 which are welded within the respective open ends of the tube 51. The upper nut 53 is adapted to receive an upper bolt 55 and the lower nut 54 is adapted to receive a lower bolt 56 as illustrated in FIG. 5. The bottom of the assembly bears against the horizontal leg of the respective runner and the lower bolt 56 extends from the bottom of the respective leg through a hole in the leg into the nut. The bolt may then be tightened down clamping the leg between the nut and the bolt head.

Likewise, the upper bolt extends through an opening 49 in the steel barrier plate 40 and into the upper nut 53 where it may be tightened down to securely fasten the strut assembly in position.

Ideally, the beach restoration assembly 10 should be placed out from the shoreline in water about 4' deep. The distance out from the shore will be determined by the slope of the bottom. It is of primary importance that the plates extend from 10" to 20" above the mean water level.

Installations in areas having a tide should have the projection above the water level determined from the water level at low tide. If the projection were based on the level at high tide, it would expose too much of the barrier plates at low tide and could result in some scouring and undercutting of the individual units. Measuring from low tide will permit the beach area to fill in, embedding the structure firmly in the buildup deposits. When that happens, buildup to high tide level can be obtained by a simple add on at the top of the plates as desired. All that is needed is plain steel sheet which can be drilled and bolted to the top of the assembly to achieve the desired results.

Probably a 2' extension will give approximately a repetition of the original 18" projection above the water line. Two holes 14" from the edge of each plate and 2" down from the baffle should be sufficient for each of the original plates.

The beach restoration structure works essentially on a valving principle. Off shore waves impinge on the structure and slide over the top. When the wave recedes, a portion of the particle bearing water is temporarily trapped so that the sand and other solids settle to the bottom inside the enclosed area. This eventually builds up a good usable beach.

As indicated above, each end of the beach restoration structure is provided with an end plate. This is to prevent water from running out at each end washing deposits out along with it. If desired, other types of end structure can be provided, such as piling additional steel sheet, etc. depending upon the particular installation.

FIG. 1 illustrates a typical beach restoration structure assembly and illustrates the mode of operation.

Eventually, sand builds up at the onshore side of the structure 10 and provides further anchoring of the beach builder units in position. As indicated above, the ballast is provided to assure that wave energy does not move the units 11, 12 and 13 out of the desired position. The ballast may be rock of various sizes and may be contained in plastic bags depending upon the composition of the stone or rock.

While the invention has been shown and described with respect to a specific embodiment thereof, this is intended for the purpose of illustration rather than limitation and other variations and modifications of the specific structure herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

I claim:

1. A beach building structure for underwater installation along the shoreline of a body of water having periodic on shore wave action comprising:

a base frame formed of interconnected members and adapted to lie on the bottom of the body of water, a ballast supporting means secured to said base frame, and adapted to receive thereon ballast formed of natural material, a barrier plate secured to the seaward portion of said base frame and angularly disposed to slope upwardly and toward said shoreline and to extend above the mean water level from about 10 percent to about 25 percent of its length to present a sloping surface to on shore waves, connection means along both side edges of the barrier plate to permit adjacent beach building structures to be rigidly interconnected to form a composite beach building structure by overlapping adjacent barrier plates and securing them to one another, and bracing means secured to the shoreward portion of said support frame for rigidly supporting said barrier plate in a fixed angularly disposed position.

2. A beach building structure as defined in claim 1 wherein said barrier plate is about 4' wide and about 7' long.

3. A beach building structure as defined in claim I wherein said barrier plate is pivotally connected at the bottom thereof to said base frame so that by removing said bracing means said barrier plate may be pivoted downward relative to said base frame whereby said barrier plate and said base frame may be transported in a relatively flat but interconnected condition.

4. A beach building structure as defined in claim 1 wherein said ballast supporting means comprises steel mesh.

5. A beach building structure as defined in claim 1 further including a baffle means secured to the seaward face of said barrier plate adjacent the top edge thereof.

6. A beach building structure as defined in claim 1 wherein said barrier plate has longitudinally extending reinforcing ribs secured to the shoreward face thereof.

7. A method for developing beach from wave-borne sand and the like along the shoreline of a body of water having periodic on shore wave action, using sand naturally entrained in off shore waves comprising the steps of:

installing a series of adjacent submerged beach building structures along a shore line generally parallel to and spaced outward from the shoreline, each of said structures comprising:

a base frame formed of interconnected members and with a ballast supporting means secured thereto, adapted to rest on the bottom of the body of water, said base frame adapted to be retained in place by solid ballast structure of natural material, a barrier plate supported at one end by said base frame and being angularly disposed to slope upwardly above the water and rearwardly toward the shoreline to present a sloping barrier surface, connection means along both side edges of the barrier plate to permit adjacent beach building structures to be rigidly interconnected to form a composite beach building structure by overlapping adjacent barrier plates and securing them to one another, and bracing means connected between the upper portion of said barrier plate and said base frame, whereby the force of wave action is deflected upwardly to reduce the force of the wave and to cause the upper portion of the wave passing over the top of the barrier plate to carry material entrained therein to be deposited between the barrier structure and the shoreline.

8. A beach building method as defined in claim 7 wherein said barrier plate extends above the mean water level from about 10" to about 20".

9. A beach building method as defined in claim 8 wherein said barrier plate extends above the mean water level about 18".

* * * * *